US009308764B2

(12) United States Patent
Hirayama et al.

(10) Patent No.: US 9,308,764 B2
(45) Date of Patent: Apr. 12, 2016

(54) SHEET FOR INK-JET PRINTING

(71) Applicant: Tokuyama Corporation, Shunan-shi, Yamaguchi (JP)

(72) Inventors: Koki Hirayama, Shunan (JP); Tadashi Fujimoto, Shunan (JP)

(73) Assignee: TOKUYAMA CORPORATION, Shunan-shi (JP)

( * ) Notice: Subject to any disclaimer, the term of this patent is extended or adjusted under 35 U.S.C. 154(b) by 0 days.

(21) Appl. No.: 14/405,885

(22) PCT Filed: May 31, 2013

(86) PCT No.: PCT/JP2013/065170

§ 371 (c)(1),
(2) Date: Dec. 5, 2014

(87) PCT Pub. No.: WO2013/187256

PCT Pub. Date: Dec. 19, 2013

(65) Prior Publication Data

US 2015/0151559 A1 Jun. 4, 2015

(30) Foreign Application Priority Data

Jun. 11, 2012 (JP) ..... 2012-131601

(51) Int. Cl.
*B41M 5/00* (2006.01)
*B41M 5/52* (2006.01)

(52) U.S. Cl.
CPC ..... *B41M 5/5218* (2013.01); *B41M 5/5227* (2013.01); *B41M 5/5254* (2013.01)

(58) Field of Classification Search
CPC . B41M 5/5218; B41M 5/5254; B41M 5/5277
See application file for complete search history.

(56) References Cited

U.S. PATENT DOCUMENTS

| | | | | |
|---|---|---|---|---|
| 2009/0233015 | A1 | 9/2009 | Fujimoto et al. | |
| 2010/0196673 | A1* | 8/2010 | Nagashima et al. | 428/195.1 |
| 2011/0117298 | A1* | 5/2011 | Hirayama | B41M 5/0035 428/32.34 |

FOREIGN PATENT DOCUMENTS

| | | | |
|---|---|---|---|
| JP | 57-157786 | A | 9/1982 |
| JP | 58-89391 | A | 5/1983 |
| JP | 58-94491 | A | 6/1983 |
| JP | 59-68292 | A | 4/1984 |
| JP | 59-95188 | A | 6/1984 |
| JP | 9-309265 | A | 12/1997 |
| JP | 2003-266925 | A | 9/2003 |

(Continued)

OTHER PUBLICATIONS

International Search Report issued in PCT/JP2013/065170, mailed on Aug. 27, 2013.

*Primary Examiner* — Betelhem Shewareged
(74) *Attorney, Agent, or Firm* — Birch, Stewart, Kolasch & Birch, LLP

(57) ABSTRACT

A sheet for ink-jet printing including a base sheet 1 and a printing layer 3 formed on a surface of the base sheet 1 and containing a plaster (shikkui) and an organic binder, wherein the printing layer 3, further, contains at least one kind of additive selected from the group consisting of glycerin, water-soluble polymer and non-ionic surfactant.

The sheet for ink-jet printing promotes the carbonatation of the plaster (shikkui) after the printing so that the printed image quickly exhibits fastness and weather-proof property due to the carbonatation of the plaster (shikkui).

6 Claims, 1 Drawing Sheet

(56) References Cited

FOREIGN PATENT DOCUMENTS

| | | | |
|---|---|---|---|
| JP | 2005-254510 | A | 9/2005 |
| JP | 2009-166476 | A | 7/2009 |
| JP | 2011-126080 | A | 6/2011 |
| WO | WO 2008/013294 | A1 | 1/2008 |

* cited by examiner

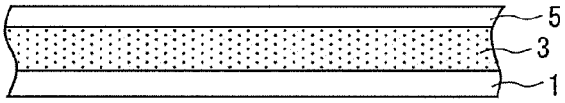
5
3
1

SHEET FOR INK-JET PRINTING

TECHNICAL FIELD

This invention relates to a sheet for ink-jet printing and, more specifically, to a sheet for ink-jet printing which includes a plaster (shikkui)-containing printing layer on which the ink-jet printing will be effected.

BACKGROUND ART

A widespread use of personal computers and digital cameras in general households is accompanied by also a widespread use of ink-jet printers that are capable of printing vivid images in full colors aided by their low prices. However, qualities of the ordinary fine papers and coated papers are not enough for meeting the requirements of the recording papers for printing used for the ink-jet printers. The printing papers now must satisfy such requirements as quickly absorbing the ink deposited on the paper surfaces, forming vivid images by suppressing ink droplets from spreading or blurring on the paper surfaces, and offering excellent color fastness of the formed images without fading color over extended periods of time.

In order to impart such proporties to the printing surfaces (paper surfaces), proposals have been made to apply onto the surface of the paper, or fill the interior of the paper with, a variety of kinds of inorganic solid matters together with a binding agent. For instance, a patent document 1 proposes the use of a synthetic silica or a salt thereof as the inorganic solid matter, a patent document 2 proposes an art of providing the surface of a paper with a weak acid salt or an oxide of a divalent metal such as magnesium or zinc as a covering layer, a patent document 3 proposes an art of providing the surface of a paper with a covering layer that contains natural or synthetic zeolite, diatomaceous earth or synthetic mica, patent documents 4 and 5 propose arts of providing an ink-absorbing layer by using a white pigment such as clay, talc, calcium carbonate, kaolin, acid clay, or active clay, and a patent document 6 proposes an art of filling with a porous and spherical granular silicate.

With the above-mentioned conventional printing papers inclusive of those papers used for laser printers other than the ink-jet printers, however, the images that are obtained are all flat without deepness of pictorial quality.

Further, upon printing the images, the above-mentioned conventional printing papers have no function for protecting the ink components from ultraviolet rays or ozone, and are not suited for being preserved for extended periods of time.

Here, the present applicant has previously developed a sheet for printing comprising a base sheet and a printing layer formed thereon and blended with a plaster (shikkui), and has proposed it in a patent document 7.

If an image is formed by using an ink-jet printer, the above sheet for printing forms an image featuring rugged appearance, depth of pictorial quality, color fastness and vividness. Besides, the printed image has very excellent weather-proof property offering excellent advantages that could not be seen with the traditional papers for ink-jet printing.

PRIOR ART DOCUMENT

Patent Documents

Patent document 1: JP-A-57-157786
Patent document 2: JP-A-58-94491
Patent document 3: JP-A-59-68292

Patent document 4: JP-A-58-89391
Patent document 5: JP-A-59-95188
Patent document 6: JP-A-9-309265
Patent document 7: WO2008/013294

OUTLINE OF THE INVENTION

Problems that the Invention is to Solve

However, the sheet for printing having the plaster (shikkui)-containing printing layer developed by the present applicant still has a problem that must be solved.

That is, the plaster (shikkui) is a kneaded product of slaked lime (calcium hydroxide) and water, and is often called lime plaster. The slaked lime reacts with the carbon dioxide gas in the air, and is solidified upon being carbonated to form the calcium carbonate. The above printing layer has been blended with the plaster (shikkui) in a state of before being completely carbonated. If an image is printed on the printing layer that contains the plaster (shikkui), ruggedness in the surface formed on the printing layer is reflected on the printed image. Namely, there is printed an image having rugged appearance and appearance of depth, the printed image being coated with the calcium carbonate and, therefore, being imparted with fastness protecting the ink components forming the images from such deteriorating factors as ultraviolet rays and, therefore, effectively preventing the colors from fading and, besides, providing excellent weather-proof property.

Here, the above properties and, specifically, the fastness and weather-proof property are exhibited after the calcium hydroxide in the plaster (shikkui) is carbonated to a sufficient degree; i.e., the above properties are not exhibited readily after the printing. At present, therefore, it has been urged to promote the carbonatation of the plaster (shikkui) after the printing.

It is, therefore, an object of the present invention to provide a sheet for ink-jet printing including a plaster (shikkui)-containing printing layer formed on a base sheet, wherein the carbonatation of the plaster (shikkui) after the printing is promoted so that the printed image quickly exhibits fastness and weather-proof property due to the carbonatation of the plaster (shikkui).

Means for Solving the Problems

According to the present invention, there is provided a sheet for ink-jet printing including abase sheet and a printing layer formed on a surface of the base sheet and containing a plaster (shikkui) and an organic binder, wherein the printing layer, further, contains at least one kind of additive selected from the group consisting of glycerin, water-soluble polymer and non-ionic surfactant.

In the sheet for ink-jet printing of the invention, it is desired that:

(1) The printing layer contains the additive in an amount of 5 to 50% by weight per the organic binder;
(2) The organic binder is a (meth)acrylic resin;
(3) The water-soluble polymer has a solubility of not less than 10% by weight in water; and
(4) The non-ionic surfactant has an HLB of not less than 10.

Effects of the Invention

The sheet for ink-jet printing of the invention has a conspicuous feature in that the printing layer that contains the plaster (shikkui) is blended with an organic binder as well as at least one kind of additive selected from the group consisting of glycerin, water-soluble polymer and non-ionic surfactant. Being blended with such additives, carbonatation of the plaster (shikkui) is promoted after the printing, the printed surface of the printing layer assumes a high degree of fastness within short periods of time and exhibits excellent scratch resistance from the initial stage.

Though the reason has not been still exactly clarified why the carbonatation of the plaster (shikkui) is promoted by the addition of the additives, the present inventors presume it to be stemming from enhanced hydrophilic property on the surface (printed surface) of the printing layer.

Namely, the printing sheet is preserved in a sealed state and, therefore, the printing layer is in a state in which part of the calcium hydroxide remains without being carbonated and, besides, its surface assumes a very porous state. If an image is ink-jet printed on the printing layer and if its surface is exposed to the atmosphere, the printing layer having high hydrophilic property easily absorbs water and quickly absorbs the ink droplets. As a result, a water film is quickly formed on the surface of the printed image, and the carbon dioxide gas in the atmosphere is quickly absorbed thereby through the water film promoting the carbonatation of the remaining calcium hydroxide.

Here, the printing layer is blended with an organic binder in order to improve toughness and to maintain the printing layer stable by preventing the solid particles from escaping. Further, the organic binder is necessary for improving close adhesion to the base sheet. The organic binder is rather oleophilic than hydrophilic and little absorbs water. On the other hand, the above-mentioned additives are all not only capable of being homogeneously dispersed in the printing layer that contains the organic binder but also exhibit highly hydrophilic property. As a result, the additives work as a hydrophilic property-imparting agent imparting hydrophilic property to the printing layer that contains the organic binder. With the hydrophilic property being highly imparted to the printing layer, therefore, it is considered that the calcium hydroxide remaining in the printing layer is quickly carbonated according to the above-mentioned principle after the ink-jet printing of image.

Owing to the carbonatation that is promoted as described above according to the present invention, improved weatherproof property is obtained from the initial stage after the ink-jet printing of image. Moreover, the surface hardness increases from an early time and the effect of protection by the calcium carbonate is exhibited. Accordingly, the printed surface on which the image is printed has a high degree of fastness and a large abrasion resistance from the initial stage.

Like the printing sheet proposed by the present applicant in the patent document 7, the printing sheet of the present invention, too, has rugged appearance on the surface of the printing layer and, therefore, the image that is printed exhibits rugged appearance with deepness of pictorial quality nourishing the feeling close to that of a wall painting, which is quite different from the photographic images.

BRIEF DESCRIPTION OF THE DRAWING

FIG. 1 is a schematic sectional view showing the structure of a printing sheet of the present invention.

MODE FOR CARRYING OUT THE INVENTION

Referring to FIG. 1, the printing sheet of the present invention comprises abase sheet 1 and a printing layer 3 formed thereon, and, further, includes, as required, a protection sheet 5 formed on the printing layer 3. The printing layer 3 in the printing sheet contains a plaster (shikkui). Upon peeling off the protection sheet 5 that is provided as required, the exposed surface of the printing layer 3 is ready to be printed.

<Base Sheet 1>

There is no specific limitation on the base sheet 1 provided the printing layer 3 containing a plaster (shikkui) can be formed on the surface thereof, and any material can be used for forming the base sheet 1. For instance, the base sheet 1 may be made from various kinds of resin sheets or resin films such as of vinyl resin like polyvinyl alcohol, polyvinyl acetate or poly(meth)acrylate, polyolefin resin like polyethylene or polypropylene, or polyester resin such as polyethylene terephthalate, or paper. Further, the base sheet 1 may be made from a woven fabric or a nonwoven fabric of a fibrous material such as glass fiber, vinylon fiber, polypropylene fiber, polyester fiber, polyethylene terephthalate fiber, acrylic fiber, aramide fiber or carbon fiber, or may be made from a composite material thereof, a laminated film or a sheet thereof.

Generally, however, it is desired that the base sheet 1 has flexibility and a suitable degree of stiffness. This is because the base sheet 1 of this kind forms a folded line little despite it is folded, and effectively suppresses such an inconvenience as formation of cracks in the plaster (shikkui)-containing printing layer 3 formed on the base sheet 1. Though a considerable limitation is imposed on the material of the base sheet 1, it is, usually, desired to use a glass fiber-mixed paper.

The glass fiber-mixed paper is obtained by mixing a wood pulp with a glass fiber, has flexibility and flexural strength, and can be closely and favorably adhered to the printing layer 3. In addition to the above glass fiber-mixed paper, there can be used a synthetic paper obtained by mixing, as a binder fiber, a chemical fiber such as polyvinyl acetate fiber, polyester fiber or vinylon fiber. The glass fiber-mixed paper that can be most favorably used as the base sheet 3 in the present invention is the one that has been placed in the market by Hokuetsu Seishi Co. in the trade name of "MPS-01".

To improve closely adhering property to the plaster (shikkui)-containing printing layer 3, the surface of the base sheet 1 may be subjected to the corona treatment to improve its hydrophilic property or may be subjected to the sand-blast treatment to increase the area for close adhesion. This makes it possible to further increase the strength of adhesion between the printing layer 3 described below and the base sheet 1.

Depending on the specifications of a printer used for the ink-jet printing, further, the thickness of the base sheet 1 is so set that the printing sheet can be easily passed through the printer.

<Printing Layer 3>

In the present invention, the printing layer 3 contains the plaster (shikkui), and is formed on the hydrophilic surface of the base sheet 1 by applying thereon a kneaded product of a powder of slaked lime (calcium hydroxide) and water and to which is, further, added an organic binder and an additive that works as a hydrophilic property-imparting agent.

That is, when the printing layer 3 is left to stand in the air, the kneaded product of the slaked lime and the calcium carbonate absorbs the carbon dioxide gas in the air, whereby the slaked lime reacts with the carbon dioxide gas to form calcium carbonate. Therefore, the printing layer 3 is, further, solidified and the surface thereof acquires an increased hardness. Usually, the hardness of the surface becomes nearly a maximum in a stage where not less than 85% of the slaked lime is carbonated.

The printing sheet of the present invention is subjected to the ink-jet printing in a state where the slaked lime is still remaining without being carbonated, and the carbonation takes place after the printing has been done. Here, however, hydrophilic property has been enhanced on the surface of the printing layer 3 due to the addition of the additive (hereinafter often called hydrophilic property-imparting agent) that will be described later. Therefore, carbonatation is promoted after the printing, properties due to the plaster (shikkui) are exhibited in a shorter period of time, and weather-proof property and fastness are exhibited in short periods of time. That is, the image formed by ink-jet printing is effectively prevented from faded by light from the initial stage of forming the image and, further, acquires a high surface hardness from an early stage of after the printing, exhibiting excellent fastness and effectively preventing the printed image from being scratched.

In the present invention, the image may be ink-jet printed on the printing layer 3 in a state where the calcium hydroxide (slaked lime) has not been completely carbonated and, desirably, in a state where the calcium hydroxide has still been held in an amount of not less than 10% by weight and, preferably, not less than 15% by weight in the plaster (shikkui) precursor. That is, if the content of the calcium hydroxide is smaller than the above range, the fastness of the image decreases and the color tends to be easily faded away. Further, if the image is ink-jet printed on the surface of the printing layer 3, the calcium hydroxide elutes in a decreased amount into the printing ink and floats in a decreased amount on the surface resulting in a decrease in the effect for protecting the printed image and in a decrease in the effect for suppressing the printed image from being deteriorated by ultraviolet rays. Moreover, if the amount of the calcium hydroxide is small, hydrophilic property decreases on the surface of the printing layer 3 and the carbonatation becomes slow after the ink-jet printing.

It is better if the amount of the calcium hydroxide is large in the printing layer from the standpoint of achieving the above-mentioned object. If its amount is too large, however, toughness of the printing layer 3 becomes insufficient and the printing layer 3 tends to be easily broken during the step of printing. It is, therefore, desired that the ratio of the calcium hydroxide in the printing layer 3 is not more than 85% by weight and, desirably, not more than 80% by weight.

The ratio of the calcium hydroxide in the printing layer can be confirmed by the X-ray diffraction.

In the present invention, the content of the calcium hydroxide in the printing layer 3 can be adjusted by adjusting the ratio of carbonatation of the calcium hydroxide used for forming the printing layer 3 or by adjusting the amounts of the organic binder, hydrophilic property-imparting agent and suitably-added other additives (inorganic fine aggregate, liquid-absorbing inorganic powder, etc.) that will be described later.

The ratio of carbonatation stands for a weight ratio of the calcium carbonate that is formed with respect to the weight of the slaked lime used for the preparation of the above-mentioned slurry.

Of the above adjusting methods, if there is employed the method of adjusting the ratio of carbonatation of the calcium hydroxide used for forming the printing layer 3, it is desired that the upper limit of the ratio of carbonatation is 80% and, specifically, 40%. That is, if the carbonatation proceeds excessively, the surface of the printing layer 3 becomes so dense that the printing ink may permeates through less.

The degree of surface density due to the carbonatation can be judged based on the abrasion resistance of the surface of the printing layer 3 as also described in Example of the above-mentioned patent document 7. It is desired that the carbonatation is suspended in a state where the abrasion resistance is class 4 or less.

In the present invention, the printing layer 3 after the image is printed thereon is left to stand in the atmosphere whereby the calcium hydroxide in the printing layer 3 is carbonated and turns into the calcium carbonate. Here, to improve the toughness of the printing layer 3, an organic binder is added to the printing layer 3. The organic binder works to form a matrix of the printing layer 3 and is present in the printing layer 3 in the form of a solid component of polymer emulsion.

The polymer emulsion is an aqueous medium in which a monomer, an oligomer or a polymer thereof is dispersed, and its representative examples are such polymers as (meth) acrylic resin, vinyl acetate resin, polyurethane or styrene/butadiene rubber.

Through the step of drying, medium (water) in the polymer emulsion undergoes evaporation, and the polymer component in the emulsion remains in the printing layer 3. If there is present too much solid component (i.e., polymer) of the emulsion, then the printed image (printing ink) may permeate less into the printing layer 3. Therefore, to improve the toughness of the printing layer 3 yet maintaining permeability of the ink, in general, it is desired that the amount of the solid component of the organic binder (polymer emulsion) in the printing layer 3 is in a range of 3 to 50% by weight.

Here, in the present invention, the surface of the printing layer 3 must be a hydrophilic surface having a hydrophilic degree as described above, and it is most desired to use a (meth)acrylic resin as the organic binder from the above-mentioned point of view.

The (meth)acrylic resin can be represented by a polyacrylic acid or a poly(meth)acrylate. However, an unsaturated compound (ethylene or styrene) having an ethylenically unsaturated double bond may be copolymerized therewith in a range in which it does not impair properties of the (meth)acrylic resin. For example, a copolymer unit stemming from the unsaturated compound may be contained in the resin in an amount of not more than 30% by mass. Further, the (meth) acrylic resin used here is not soluble in water and, in this regard, is different from the water-soluble polymer having high solubility in water.

In the invention, further, in addition to adding the above-mentioned organic binder, a hydrophilic property-imparting agent must be added to the kneaded product of the slaked lime and water. Use of the hydrophilic property-imparting agent helps improve the hydrophilic property of the printing layer 3 and promote the carbonatation of the calcium hydroxide that is remaining after the printing.

As the hydrophilic property-imparting agent, there can be used glycerin, water-soluble polymer or non-ionic surfactant in a single kind or in a combination of two or more kinds.

Among them, the water-soluble polymer is a polymer having a solubility in water (25° C.) of not less than 10% by mass, such as polyvinyl alcohol, polyvinyl pyrrolidone, polyethylene glycol, polypropylene glycol, polyethylene oxide, methyl cellulose, ethyl cellulose, hydroxypropyl cellulose, polyvinyl alcohol-polyacrylic acid block copolymer, polyvinyl alcohol-polyacrylic ester block copolymer or polyglycerine.

The non-ionic surfactant that is preferably used has the HLB of not less than 10 and, specifically, 12 to 18. On condition that the HLB lies in the above range, there is preferably used such a non-ionic surfactant as polyoxyethylenephenyl ether, polyoxyethylenephenyl ether condensed with formalin, polyethylene glycol fatty acid ester, glycerin ester, polyoxyethylenesorbitan fatty acid ester, sorbitan fatty acid ester, glycerin fatty acid ester, polyoxyethylene fatty acid ester, castor oil cured with polyoxyethylene, polyoxyethylenealkylamine or alkylalkanolamide.

In the present invention, the hydrophilic property-imparting agent is, preferably, the glycerin or the water-soluble polymer and, most preferably, the glycerin.

In the present invention, the hydrophilic property-imparting agent is added, usually, in an amount of 5 to 50 parts by mass per 100 parts by mass of the organic binder (specifically preferably, (meth)acrylic resin) from the standpoint of forming the above-mentioned hydrophilic surface though the amount thereof may differ depending on its kind.

If the amount of the hydrophilic property-imparting agent is smaller than the above range, the effect is low for promoting the carbonatation of the plaster (shikkui) after the printing. If it is added in more than the required amount, the hydrophilic property is enhanced excessively and, therefore, the hardness very decreases in the surface of the printing layer 3 of when the image is ink-jet printed thereon and the printing layer 3 tends to be easily broken during the printing.

The printing layer 3 may be, further, blended with various kinds of additives for adjusting properties of the printing layer 3, such as various fiber materials, inorganic fine aggregate and liquid-absorbing inorganic powder in addition to being blended with the above-mentioned organic binder and the hydrophilic property-imparting agent. These additives are for improving physical properties such as strength and the like of the printing layer 3.

As the fiber materials, there can be exemplified glass fiber, vinylon fiber, polypropylene fiber, polyester fiber, polyethylene terephthalate fiber, acrylic fiber, aramid fiber, carbon fiber and metal fiber. Further, the fiber may be in the form of a staple fiber, a filament, a woven fabric or a nonwoven fabric. Among them, the staple fiber is particularly effective in improving the toughness and cutting workability of the printing layer 3. Though there is no specific limitation on the length and diameter of the staple fiber, it is desired that the length thereof is 1 mm to 10 mm and, specifically, 2 mm to 6 mm, and the diameter is 5 to 50 μm and, specifically, 10 to 30 μm from the standpoint of further improving the toughness of the printing layer 3 and imparting excellent cutting workability thereto depending on the cases.

The inorganic fine aggregate is an inorganic granular material having an average grain size in a range of about 0.01 to about 2 mm. Concretely, there can be exemplified silica sand, lime sand, mica, glazing silica sand, glazing mica, ceramic sand, glass beads, perlite or calcium carbonate having an average grain size within the above range which is not more than one half the thickness of the printing layer 3.

According to the present invention, further, there can be also used the liquid-absorbing inorganic powder to compensate for a decrease in the hydrophilic property to the hydrophilic ink caused by the use of the polymer emulsion in the printing layer 3 and to compensate for a decrease in the liquid-absorbing property caused by the progress of carbonatation of the calcium hydroxide in the printing layer 3. The liquid-absorbing inorganic powder is a porous and fine inorganic powder that absorbs oils in amounts of as large as 100 ml/100 g, such as alumina powder or zeolite powder having an average grain size ($D_{50}$) calculated as volume of not more than 0.1 μm as measured by, for example, the laser diffraction/light scattering method.

That is, the polymer emulsion is effective in improving the toughness and the close adhesion (strength of junction) between the base sheet 1 and the printing layer 3 lowering, however, the hydrophilic property of the printing layer 3. Therefore, despite the hydrophilic property-imparting agent is used, the hydrophilic ink that is used for printing the image is repelled causing such an inconvenience as blurring in the printed image. Here, however, use of the above liquid-absorbing inorganic powder improves property for absorbing the printing ink and is desired from the standpoint of effectively preventing the above-mentioned inconvenience. Specifically, it is desired that the liquid-absorbing inorganic powder is contained in the printing layer 3 in an amount of about 0.5 to about 10% by weight.

In the invention, the additives that are added to the printing layer 3 may be of a single kind or may be of two or more kinds in combination depending on the object. In either way, they should be added in such amounts that do not interrupt the printing ink from permeating into, and being fixed in, the printing layer 3 and do not impair the hydrophilic degree on the surface of the printing layer 3. It is desired that the additives are added in such amounts that the content of the calcium carbonate (i.e., the content of the calcium carbonate of when the carbonatation ratio is 100%) formed by the carbonatation of the slaked lime is maintained to be not less than 50% by weight.

The thickness of the printing layer 3 is set to lie in a suitable range in which the printing can be executed and is, usually, set to lie in a range of 0.05 to 0.5 mm and, specifically, about 0.1 to about 0.25 mm. If the thickness is too small, the image that is printed cannot be well fixed due to the permeation of the printing ink or the image that is expressed utilizing the ruggedness fails to exhibit deep appearance. The printing layer 3 that is too thick, on the other hand, is not advantageous in economy and tends to easily form folding lines when it is folded imposing limitation on the printer that is used for printing.

<Protection Sheet 5>

The printing layer 3 is made from inorganic particles (particles of calcium hydroxide and calcium carbonate), and is relatively brittle and is liable to be scratched by the external pressure to lose commercial value. Therefore, a protection sheet 5 can be provided on the upper surface of the printing layer 3 in order to protect the surface of the printing layer 3 just after the production of the printing sheet until it is printed by a general customer. The protection sheet 5 is peeled off at the time of the printing but also has a function of forming distinct ruggedness in the surface of the printing layer 3 by removing part of the surface at a moment when it is peeled off. It is, therefore, desired that the protection sheet 5 is provided maintaining a peeling strength of 200 to 4000 mN/25 mm and, specifically, 800 to 2000 mN/25 mm. This is because if the peeling strength is too large, it becomes difficult to peel off the protection sheet 5 at the time of printing and if the peeling strength is too small, it may become difficult to form ruggedness of a sufficiently large size in the surface of the printing layer 3 when the protection sheet 5 is peeled off.

The above peeling strength is a value measured by using a test piece of a width of 25 mm and pulling it at a tension speed of 300 mm/min in compliance with the JIS-K6854-2, Adhesives—Determination of Peel Strength of Bonded Assemblies, Part 2; 180-degree Peeling.

The above protection sheet 5 may be made from any material so far as it has the protection function and can be provided on the printing layer 3 maintaining the peeling strength as described above. Usually, however, there can be used, as the protection sheet 5, a woven fabric or a nonwoven fabric of such a fibrous material as glass fiber, vinylon fiber, polypropylene fiber, polyester fiber, polyethylene terephthalate fiber, acrylic fiber, aramide fiber or carbon fiber. As the protection sheet 5, further, there can be also used a gas non-permeable sheet such as silicon paper to impart the function of protecting the printing layer 3 as well as the function of preventing the carbonatation of the printing layer 3 until images are printed thereon.

The protection sheet 5 may have such a thickness as to exhibit a suitable protection function and is, usually, about 0.01 to about 2.0 mm thick.

<Production of the Printing Sheet>

The printing sheet of the invention mentioned above can be produced by a known method which is the same as the method of producing the printing sheet disclosed in the patent document 7 but blending the plaster (shikkui) slurry (kneaded product of water and slaked lime) for forming the printing layer 3 with the polymer emulsion that serves as an organic binder and the above-mentioned hydrophilic property-imparting agent.

Namely, one surface of the base sheet 1 that forms the printing layer 3 is coated with the plaster (shikkui) slurry that contains the organic binder, the hydrophilic property-imparting agent and, as required, various additives, and, at the same time, is stuck with the protection sheet 5 as required followed by a suitable degree of drying to form the printing layer 3 to thereby produce the printing sheet.

<Printing Sheet>

The printing sheet of the present invention obtained as described above is placed in the market as a product in a state of being stuck with the protection sheet 5 that is suitably provided or in a state of peeling the protection sheet 5 off. Here, however, if the printing layer 3 is left to stand in the atmosphere, the plaster (shikkui) undergoes the carbonatation and, therefore, its printability (e.g., permeability and fixing of image) may decrease. To avoid such inconvenience, the carbonatation must be suppressed until the moment of printing.

To suppress the carbonatation of the printing layer 3, for example, a long printing sheet cut into a suitable size is wound up like a roll and is then wrapped with a gas non-permeable film to preserve it. Or the printing sheet that is cut may be wrapped piece by piece with the gas non-permeable film to preserve the pieces thereof. Many pieces of the printing sheet may be stacked one upon another, and the thus obtained stack may be wrapped with the gas non-permeable film to preserve it.

If the protection sheet 5 has been stuck, the upper surface of the protection sheet 5 and the back surface of the base sheet 1 may be laminated with the gas non-permeable film to preserve the printing sheet.

As the gas non-permeable film, there can be used various kinds of resin films that have, usually, been used as packing films without any specific limitation. From the standpoint of cost and the like, however, it is most desired to use a polyolefin film such as polyethylene film.

To use the printing sheet that has been placed in the market as described above, the packing film is removed and, next, the protection sheet 5 is peeled off if it is present to let the surface of the printing layer 3 exposed so that images can be printed thereon.

By using inks in which predetermined pigments of dyes have been dispersed or dissolved, the images are printed on the printing sheet by using an ink-jet printer. The inks to be used are, most desirably, hydrophilic inks in which water-soluble dyes are dissolved or pigments are dispersed in water (or a water/alcohol mixed solvent, etc.) with the use of a surfactant. If the hydrophilic inks are used, there can be formed vivid images on the printing layer 3 without blurring and maintaining stability. In particular, the invention, preferably, uses the inks that contain pigments.

As described already, the printing layer 3 on which the image is printed as described above is left to stand in the atmosphere where it quickly absorbs the carbon dioxide gas in the atmosphere, and the calcium hydroxide that is remaining undergoes the carbonatation and is solidified. After, for example, about 120 hours from when the image was printed, the printing layer 3 exhibits excellent properties such as weather-proof property and fastness; i.e., excellent properties are exhibited from a considerably early stage after the printing. Despite the printing layer 3 is rubbed, the colors do not fade away and, besides, the ink components are protected from the ultraviolet rays and remain stable for extended periods of time.

Moreover, the images that are printed permeate into the rugged and porous plaster (shikkui) and are fixed therein to exhibit deep appearance of pictorial quality as compared to photographic images.

EXAMPLES

Excellent effects of the invention will now be described by the following Experimental Examples.

Described below are the testing methods and materials used in the Experimental Examples.

(1) Hydrophilic Property:

In compliance with the JIS R 3257, pure water was dropped on the surface of the printing layer 3, and the angle of contact at this moment was measured to evaluate the hydrophilic property.

Measuring apparatus: automatic contact angle meter (Model: DM301 manufactured by Kyowa Kaimen Kagaku Co.)

Measuring temperature: 25° C.

Measuring humidity: 50% RH (2) Blurring Ratio of Image:

By using the ink-jet printer (PX-5500 manufactured by Epson Co., using water-soluble inks in which pigments are dispersed), an image of a circle of 10 mm in diameter was printed on the surfaces of the printing sheets prepared under the conditions shown in Examples and Comparative Examples. By using a commercially available color scanner, the printed images (circular images) were read by a personal computer as digital images. By using an image-processing software, the numbers of the pixels of the transferred colors were measured and were compared with the numbers of the pixels that have been printed on a paper (plain paper) for exclusive use in the ink-jet printer, and the blurring ratio (SR) was calculated according to the following formula, $$SR=P1/P0$$

SR: Blurring ratio (-) which is usually not less than 1 and increases with an increase in the blurring.

P1: Number of the pixels of the printed image.

P0: Number of the pixels of the image printed on the paper for exclusive use in the ink-jet printer.

(3) Abrasion Testing:

Abrasion test when wet was conducted in compliance with the JIS-A 6921, and the degree of abrasion resistance (class) was measured in the evaluation of five steps.

Abrasion resistance: Evaluation in five steps of classes 1 to 5; class 5 is the highest degree of abrasion resistance.

(4) Weather-Proof Property Testing:

There were provided printing papers (A4-size) prepared under the conditions of the Examples and Comparative Examples and commercially available printing papers (A4-size). Each piece of paper was divided into four equal regions and on which four colors, i.e., yellow, red, blue and black, were printed by using an ink-jet printer (PX-5500 manufactured by Epson Co., using aqueous inks in which pigments were dispersed). The papers were provided each in duplicate, the four colors of yellow, red, blue and black being printed on each of the regions. The papers each in one piece were irradiated with ultraviolet rays of an intensity of 500 μW/cm$^2$ by using a fluorescent lamp for irradiating ultraviolet rays (fluorescent lamp, Model FL30SBL-360 manufactured by Mitsubishi Electric Co.), and the rest of the papers each in the other piece were preserved in a dark place.

The papers irradiated with the ultraviolet rays for a predetermined period of time and the papers preserved in the dark place were taken out. By using a spectral color difference meter (Handy-type easy spectral color difference meter, Model NF333 manufactured by Nihon Denshoku Co.), these papers were found for their color differences (ΔE1 to ΔE4) for the four colors of yellow, red, blue and black in the L*, a* and b* coloring systems in the portions irradiated with ultraviolet rays and in the non-irradiated portions in compliance with the JIS Z 8730. Further, an average value ΔEav was found in compliance with the following formula and was used as an index of weather-proof property.

$$\Delta Eav=(\Delta E1+\Delta E2+\Delta E3+\Delta E4)/4$$

The value increases with an increase in the change in color.

ΔE1: Color difference between the ultraviolet-irradiated portion and the non-irradiated portion in the yellow region.

ΔE2: Color difference between the ultraviolet-irradiated portion and the non-irradiated portion in the red region.

ΔE3: Color difference between the ultraviolet-irradiated portion and the non-irradiated portion in the blue region.

ΔE: Color difference between the ultraviolet-irradiated portion and the non-irradiated portion in the black region.

(A) Base Sheet:

Calcium carbonate paper: "OK Cosmo CA 135" (thickness, 0.18 mm; weight 138 g/m$^2$), manufactured by Oji Seishi Co.

Glass fiber-mixed paper: "MPS-01" (thickness, 0.35 mm; weight, 85 g/m$^2$), manufactured by Hokuetsu Seishi Co.

(B) Calcium Hydroxide:

Slaked lime: "Highly Pure Slaked Lime CH", manufactured by Ube Materials Co.

(C) Inorganic Powder:

Calcium carbonate: "White 7", manufactured by Yakusen Sekkai Co.

(D) Aqueous Emulsion:

Acrylic copolymerized latex:

"Polytron", comonomer content, 25% by weight; solid component, 40% by weight, manufactured by Asahi Kasei Kogyo Co.

(E) Glycerin: Manufactured by Wako-Junyaku Co.

(F) Water-Soluble Polymers:

Polyvinyl pyrrolidone, manufactured by Wako-Junyaku Co. (average molecular weight, 35,000)

Polyvinyl alcohol, manufactured by Wako-Junyaku Co. (average molecular weight, 500, completely saponified type)

Polyethylene glycol, manufactured by Wako-Junyaku Co. (average molecular weight, 300)

(G) Non-Ionic Surfactant:

Polyoxyethylenelauryl ether, "Emulgen 123P", manufactured by Kao Co.
HLB 16.9

Polyethylene fatty acid ester, "Emanone 1112", manufactured by Kao Co.
HLB 13.7

(H) Protection Sheet:

Nonwoven fabric A, "BT-1306 WM" (product number), manufactured by Unicel Co.

Production Examples 1 to 3

Slaked lime slurries were obtained by kneading the slaked lime, aqueous emulsion, water and glycerin at ratios as shown in Table 1. Next, by using a bar coater, the slaked lime slurries obtained above were applied onto the surfaces of calcium carbonate papers (400×300 mm) used as the base sheets and, immediately thereafter, the nonwoven fabric A (protection sheet) was closely adhered onto the surfaces of the slurries and was dried in a drier maintained at 60° C. for 20 minutes. The thus produced printing sheets were measured for their abrasion resistances immediately after the production to find that the results were all class 3.

Comparative Production Examples 1 and 2

A printing sheet having a printing layer was obtained by using the slurry of the same composition as that of the above Examples but without using glycerin (Comparative Production Example 1). The abrasion resistance was class 3.

Another printing sheet having a printing layer was obtained by using the slurry of the same composition as that of the above Examples but without using glycerin and, further, using the calcium carbonate instead of the calcium hydroxide (Comparative Production Example 2). The abrasion resistance was class 2.

The blending ratios of these Comparative Production Examples were as shown in Table 1.

TABLE 1

| Production Example/ Comparative production Example | Slaked lime (pts. by wt.) | Calcium carbonate (pts. by wt.) | Aqueous emulsion (pts. by wt.) | Water (pts. by wt.) | Glycerin (pts. by wt.) |
|---|---|---|---|---|---|
| Production Example 1 | 100 | — | 50 | 25 | 2 |
| Production Example 2 | 100 | — | 50 | 24 | 5 |
| Production Example 3 | 100 | — | 50 | 23 | 10 |
| Comparative Production Example 1 | 100 | — | 50 | 25 | 0 |
| Comparative Production Example 2 | — | 100 | 50 | 25 | 0 |

Examples 1 to 3 and Comparative Examples 1 and 2

The printing sheets just after produced according to Production Examples 1 to 3 and Comparative Production Examples 1 and 2, were measured for thicknesses of the printing layers, blurring ratios and angles of contact to obtain the results as shown in Table 2.

The printing sheets were, further, left to stand in a room for 0 day, 5 days and 20 days to carbonate the slaked lime (calcium hydroxide) in the printing layers. Table 2 shows the ratios of the slaked lime in the printing layers of the obtained printing sheets. Here, however, the printing sheet of Comparative Example 2 was not carbonated.

TABLE 2

| Examples/ Comparative Examples | Thickness of printing layer (mm) | Blurring ratio (—) | Angle of contact (deg.) | Ratio of slaked lime in the printing layer (% by wt.) 0 day | 5 days | 20 days |
|---|---|---|---|---|---|---|
| Example 1 | 0.15 | 1.05 | 78 | 70 | 55 | 31 |
| Example 2 | 0.14 | 1.05 | 57 | 68 | 49 | 24 |
| Example 3 | 0.15 | 1.04 | 41 | 67 | 40 | 18 |
| Comparative Example 1 | 0.15 | 1.04 | 115 | 78 | 64 | 48 |
| Comparative Example 2 | 0.14 | 1.41 | 95 | 0 | 0 | 0 |

Examples 1 to 3 and Comparative Production Examples 1 and 2, were printed in four colors of yellow, red, blue and black, and were left to stand in the room for 3 hours and were, thereafter, tested for their weather-proof properties. In the weather-proof property testing, the average color differences (ΔEav) were measured after one month and 4 months have passed to obtain the results as shown in Table 3 which also shows the abrasion resistances of after the printing sheets were left to stand in the room for 20 days.

TABLE 3

| Examples/ Comparative Examples | Average color difference (ΔEav) After 1 month | After 4 months | Abrasion resistance (class) After 20 days |
|---|---|---|---|
| Example 1 | 1.9 | 4.6 | 5 |
| Example 2 | 1.5 | 4.1 | 5 |
| Example 3 | 1.3 | 3.2 | 5 |
| Comparative Example 1 | 2.8 | 6.1 | 4 |
| Comparative Example 2 | 4.5 | 14.4 | 2 |

Production Examples 4 to 9

Slaked lime slurries were obtained with the same blending ratio as that of the above Production Example 1 but changing the glycerin into aqueous polymers shown in Table 4. Next, by using the bar coater, the slaked lime slurries obtained above were applied onto the surfaces of glass fiber-mixed papers (400×300 mm) that were used as the base sheets and, immediately thereafter, the nonwoven fabric A (protection sheet) was closely adhered onto the surfaces of the slurries and was dried in the drier maintained at 70° C. for 20 minutes. The thus produced printing sheets were measured for their abrasion resistances immediately after the production to find that the results were all class 3.

TABLE 4

| Production Example | Polyvinyl pyrrolidone (pts. by wt.) | Polyvinyl alcohol (pts. by wt.) | Polyethylene glycol (pts. by wt.) |
|---|---|---|---|
| Production Example 4 | 4 | — | — |
| Production Example 5 | 8 | — | — |
| Production Example 6 | — | 3 | — |
| Production Example 7 | — | 6 | — |

TABLE 4-continued

| Production Example | Polyvinyl pyrrolidone (pts. by wt.) | Polyvinyl alcohol (pts. by wt.) | Polyethylene glycol (pts. by wt.) |
|---|---|---|---|
| Production Example 8 | — | — | 5 |
| Production Example 9 | — | — | 10 |

Examples 4 to 9

The printing sheets just after produced according to Production Examples 4 to 9 were measured for thicknesses of the printing layers, blurring ratios and angles of contact to obtain the results as shown in Table 5.

The printing sheets were, further, left to stand in the room for 0 day, 5 days and 20 days to carbonate the slaked lime (calcium hydroxide) in the printing layers. Table 5 shows the ratios of the slaked lime in the printing layers of the obtained printing sheets.

TABLE 5

| Examples/ Comparative Examples | Thickness of printing layer (mm) | Angle of contact (deg.) | Blurring ratio (—) | Ratio of slaked lime in the printing layer (% by wt.) 0 day | 5 days | 20 days |
|---|---|---|---|---|---|---|
| Example 4 | 0.15 | 82 | 1.04 | 73 | 51 | 32 |
| Example 5 | 0.14 | 77 | 1.03 | 71 | 45 | 25 |
| Example 6 | 0.14 | 78 | 1.06 | 74 | 49 | 34 |
| Example 7 | 0.15 | 72 | 1.05 | 73 | 46 | 26 |
| Example 8 | 0.16 | 70 | 1.03 | 71 | 49 | 33 |
| Example 9 | 0.15 | 64 | 1.03 | 70 | 44 | 24 |

Next, the printing sheets obtained in Production Examples 4 to 9 were printed in four colors of yellow, red, blue and black, and were left to stand in the room for 3 hours and were, thereafter, tested for their weather-proof properties. In the weather-proof property testing, the average color differences (ΔEav) were measured after one month and 4 months have passed to obtain the results as shown in Table 6 which also shows the abrasion resistances of after the printing sheets were left to stand in the room for 20 days.

TABLE 6

| Examples/ Comparative Examples | Average color difference (ΔEav) After 1 month | After 4 months | Abrasion resistance (class) After 20 days |
|---|---|---|---|
| Example 4 | 1.8 | 3.3 | 5 |
| Example 5 | 1.4 | 3.1 | 5 |
| Example 6 | 1.7 | 2.7 | 5 |
| Example 7 | 1.7 | 2.5 | 5 |
| Example 8 | 1.5 | 2.9 | 5 |
| Example 9 | 1.6 | 2.8 | 5 |

Production Examples 10 and 11

Slaked lime slurries were obtained with the same blending ratio as that of the above Production Example 1 but changing the glycerin into non-ionic surfactants shown in Table 7. Next, by using the bar coater, the slaked lime slurries obtained above were applied onto the surfaces of the glass fiber-mixed papers (400×300 mm) that were used as the base sheets and, immediately thereafter, the nonwoven fabric A (protection sheet) was closely adhered onto the surfaces of the slurries and was dried in the drier maintained at 70° C. for 20 minutes. The thus produced printing sheets were measured for their abrasion resistances immediately after the production to find that the results were all class 3.

TABLE 7

| Production Example | Polyoxyethylene lauryl ether (pts. by wt.) | Polyethylene fatty acid ester (pts. by wt.) |
|---|---|---|
| Production Example 10 | 1.5 | — |
| Production Example 11 | — | 1.5 |

Examples 10 and 11

The printing sheets just after produced according to Production Examples 10 and 11 were measured for thicknesses of the printing layers, blurring ratios and angles of contact to obtain the results as shown in Table 8.

The printing sheets were, further, left to stand in the room for 0 day, 5 days and 20 days to carbonate the slaked lime (calcium hydroxide) in the printing layers. Table 8 shows the ratios of the slaked lime in the printing layers of the obtained printing sheets.

TABLE 8

| Examples | Thickness of printing layer (mm) | Angle of contact (deg.) | Blurring ratio (—) | Ratio of slaked lime in the printing layer (% by wt.) 0 day | 5 days | 20 days |
|---|---|---|---|---|---|---|
| Example 10 | 0.14 | 87 | 1.08 | 76 | 55 | 34 |
| Example 11 | 0.14 | 85 | 1.08 | 76 | 53 | 37 |

Next, the printing sheets obtained in Production Examples 11 and 10 were printed in four colors of yellow, red, blue and black, and were left to stand in the room for 3 hours and were, thereafter, tested for their weather-proof properties. In the weather-proof property testing, the average color differences (ΔEav) were measured after one month and 4 months have passed to obtain the results as shown in Table 9 which also shows the abrasion resistances of after the printing sheets were left to stand in the room for 20 days.

TABLE 9

| Examples/ Comparative Examples | Average color difference (ΔEav) After 1 month | After 4 months | Abrasion resistance (class) After 20 days |
|---|---|---|---|
| Example 4 | 1.9 | 4.5 | 5 |
| Example 5 | 1.8 | 4.7 | 5 |

DESCRIPTION OF REFERENCE NUMERALS

1: base sheet
3: printing layer
5: protection sheet

The invention claimed is:

1. A sheet for ink jet printing including a base sheet and a printing layer formed on a surface of said base sheet and containing a plaster (shikkui) and an organic binder, wherein said printing layer, further, contains at least one kind of additive selected from the group consisting of glycerin, water-soluble polymer and non-ionic surfactant, and wherein said printing layer has a thickness of 0.1 mm to 0.5 mm.

2. The sheet for ink-jet printing according to claim 1, wherein said printing layer contains said additive in an amount of 5 to 50% by weight per said organic binder.

3. The sheet for ink-jet printing according to claim 1, wherein said organic binder is a (meth)acrylic resin.

4. The sheet for ink-jet printing according to claim 1, wherein said water-soluble polymer has a solubility of not less than 10% by weight in water.

5. The sheet for ink-jet printing according to claim 1, wherein said non-ionic surfactant has an HLB of not less than 10.

6. The sheet for ink-jet printing according to claim 1, wherein said printing layer contains $CaCO_3$ and $Ca(OH)_2$, and a total amount of the $Ca(OH)_2$ in terms of $CaCO_3$, and the $CaCO_3$, is not less than 50% by weight in the printing layer.

* * * * *